US006011358A

United States Patent [19]

Knobloch et al.

[11] Patent Number: 6,011,358

[45] Date of Patent: Jan. 4, 2000

[54] BALLAST FOR INDEPENDENT PARALLEL OPERATION OF LOW-PRESSURE GAS DISCHARGE LAMPS

[75] Inventors: Gert Knobloch, Pluederhausen; Peter Haaf, Schorndorf, both of Germany

[73] Assignee: Vossloh-Schwabe GmbH, Urbach, Germany

[21] Appl. No.: 09/055,995

[22] Filed: Apr. 7, 1998

[30] Foreign Application Priority Data

Apr. 12, 1997 [DE] Germany ..... 197 15 342

[51] Int. Cl.[7] ..... H05B 37/02

[52] U.S. Cl. ..... 315/224; 315/324; 315/225; 315/307

[58] Field of Search ..... 315/307, 297, 315/324, 312, 224, 209 CD, 209 T, 209 R, 219, 291, 350, 225, 289, 308, DIG. 5

[56] References Cited

U.S. PATENT DOCUMENTS

| | | | |
|---|---|---|---|
| 4,710,682 | 12/1987 | Zuchtriegel | 315/224 |
| 5,422,548 | 6/1995 | Yamashita et al. | 315/308 |
| 5,465,029 | 11/1995 | Hanazaki et al. | 315/219 |
| 5,583,399 | 12/1996 | Rudolph | 315/291 |
| 5,770,925 | 6/1998 | Konopka et al. | 315/225 |

FOREIGN PATENT DOCUMENTS

| | | |
|---|---|---|
| 0 239 793 | 10/1987 | European Pat. Off. . |
| 0 285 049 | 5/1988 | European Pat. Off. . |
| 0 687 135 | 12/1995 | European Pat. Off. . |
| 34 32 266 | 3/1985 | Germany . |
| 42 43 955 | 6/1994 | Germany . |

*Primary Examiner*—Don Wong
*Assistant Examiner*—Wilson Lee
*Attorney, Agent, or Firm*—Foley & Lardner

[57] ABSTRACT

An electronic ballast is provided for the operation of one or more gas discharge lamps. The electronic ballast has at least one inverter half bridge and a driving circuit that prescribes the inverter frequency. In the event of overvoltage across a gas discharge lamp, the driving circuit is brought into a locking state in which it blocks the inverter half bridge. This is performed via a circuit resembling a thyristor, which reduces the supply voltage of the driving circuit below a predetermined value. Provided for the purpose of unlocking and restarting the driving circuit is a detector circuit which detects the insertion of a new gas discharge lamp into its respective holder. This is accomplished by pinpoint detection of a steep pronounced voltage rise at a terminal of a gas discharge lamp which is connected to the intermediate circuit voltage via the filament of the gas discharge lamp. The detector circuit contains a filter which filters out and evaluates the voltage rise and suppresses interference voltages which could otherwise lead to defective restarting operations.

21 Claims, 1 Drawing Sheet

BALLAST FOR INDEPENDENT PARALLEL OPERATION OF LOW-PRESSURE GAS DISCHARGE LAMPS

Figure 1:
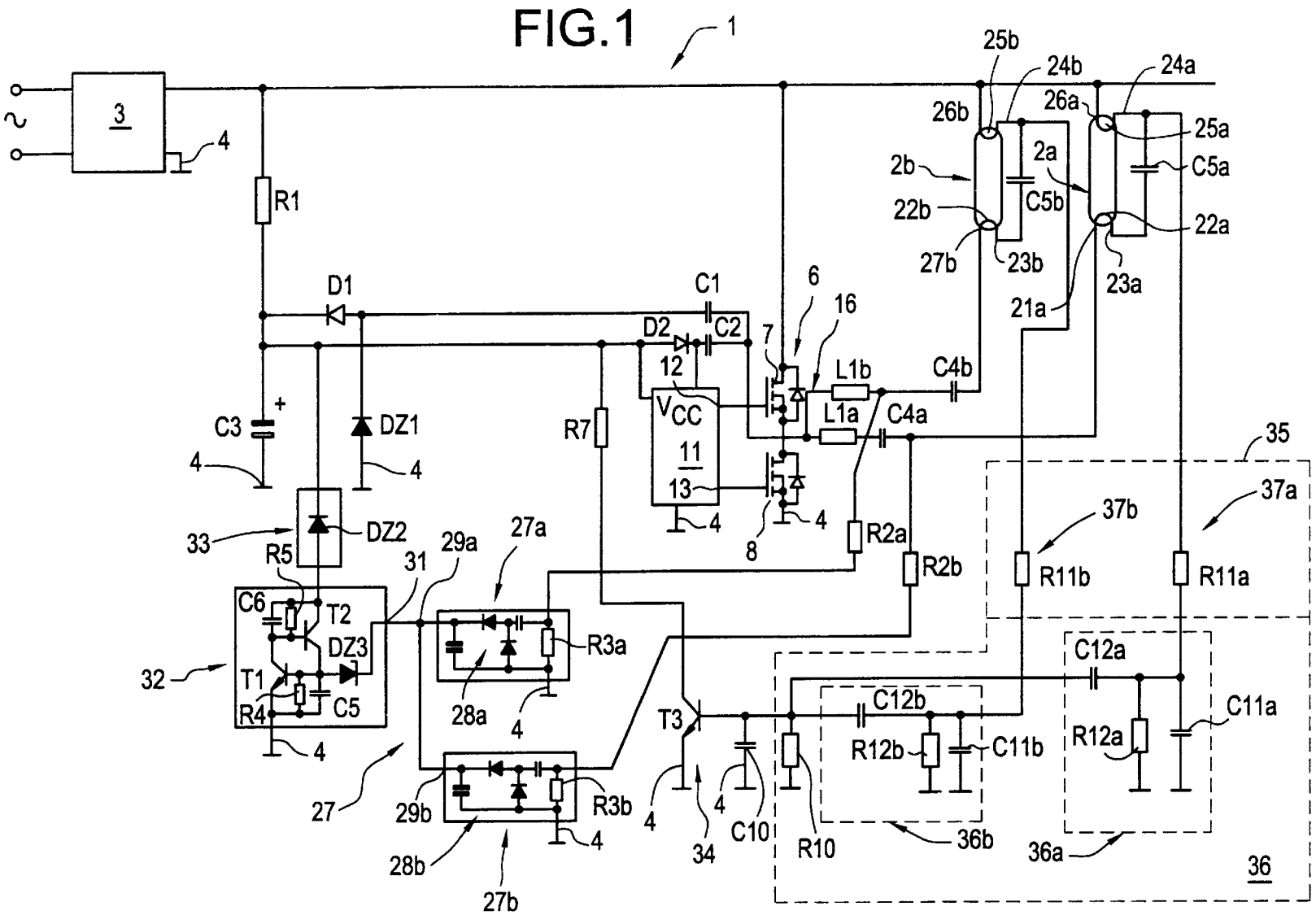

The disclosed invention relates to an electronic ballast for use in low-pressure gas discharge lamps. In particular, the invention relates to an externally controlled ballast having an inverter whose frequency is prescribed by a controlled oscillator.

For the purpose of operating low-pressure gas discharge lamps, increasing use is being made of ballasts which not only start the relevant gas discharge lamp and supply it with the required voltage and the desired current, but also monitor the operation of the lamp. In the case of practically constructed luminaires, a plurality of lamps are frequently combined which then have to be supplied separately in each case with current and voltage. Ballasts have become known for this purpose which permit simultaneous parallel operation of two low-pressure gas discharge lamps. It is also necessary to monitor the operation of each individual lamp.

For example, EP 0 239 793 B1 has disclosed a freely oscillating electronic ballast which can supply two gas discharge lamps simultaneously. This purpose is served by a freely oscillating inverter which feeds two series resonant circuits connected in parallel with one another. Each series resonant circuit is assigned a dedicated low-pressure gas discharge lamp. In order to monitor the voltage drop across the gas discharge lamps, the respective upstream resonance inductor is constructed as a transformer whose voltage drop likewise rises with rising lamp voltage. The secondary sides of the two transformers are connected to a detector circuit which is connected via a trigger circuit to the gate electrode of a thyristor. In the case of a fault, the latter earths the base of an inverter transistor, in order to inactivate said base and thus to stop the ballast from operating.

Via a resistor combination, the thyristor is supplied with a holding current from the intermediate circuit voltage, and thus blocks the ballast permanently. In order to enable a lamp to be changed after restarting, each lamp is provided with a turn-off capacitor which briefly takes over the thyristor current during insertion of the lamp, and thus blocks said current.

If, in the case of a fault, in which the gas discharge lamps go out, both are removed and an intact lamp is firstly reinserted, the latter releases the ballast and starts.

The freely oscillating ballast is not stable with respect to frequency, and so it has to be accepted that the individual lamp inserted must have a power which is higher than in the case of normal operation. If no second lamp is inserted, for example because only a single gas discharge lamp is desired, the gas discharge lamp may be overloaded. However, it is sometimes desirable to be able to operate a luminaire alternatively with one or two (or more) gas discharge lamps, in order to be able to control the brightness.

A turn-off capacitor, which must have a minimum charge, is required in order to turn off the thyristor in the case of the known circuit mentioned above when reinserting the lamp. This capacitor, which is charged up to the intermediate circuit voltage in the case of turning off after removal of the lamp, must have not only a minimum capacitance, but also a dielectric strength which corresponds to the intermediate circuit voltage. It must also be resistant to switching transience. This results in a substantial component size. Further, a capacitor is required for each gas discharge lamp, and, therefore their sizes add together. This increases the size of the ballast.

Finally, it is also to be borne in mind when designing an electronic ballast that it must be reliably turned off in the case of a detected fault and remain in said state until the fault is rectified. Restarting when the fault still exists is to be avoided.

The result of this is the object on which the invention is based, specifically to create an electronic ballast which alternatively permits the operation of one or more gas discharge lamps, and restarts upon the insertion of a lamp after being turned off as a consequence of an impermissible operating state, without needing to be separated from the power system.

The electronic ballast according to the invention has at least one inverter half bridge, which is externally controlled by a driving circuit. The driving circuit prescribes the operating frequency, with the result that it is possible to reduce or exclude undesired reactions from the lamp circuit on the operating frequency. The fixed frequency produces in the individual lamp circuits conditions which are independent of the number of the lamp circuits connected to the inverter half bridge. The electronic ballast is therefore suitable, if required, for operating different numbers of discharge lamps. If, for example, only a single gas discharge lamp is connected to a ballast provided for two such lamps, said lamp can be operated without being overloaded and its service life thereby being lowered. In this way, UV emissions otherwise occurring toward the end of the service life of the overloaded gas discharge lamp can also be avoided or reduced.

The electronic ballast is provided with a voltage monitoring device which monitors the operating voltage of each individual gas discharge lamp. As soon as even only one of the gas discharge lamps present has an operating voltage which exceeds a maximum value, the driving circuit of the inverter half bridge is inactivated, and the inverter half bridge is completely blocked. Turning off is performed by switching on a first switch with a breakdown characteristic, which pulls the supply voltage of the driving circuit below a threshold value UVLO (undervoltage lockout) below which the driving circuit blocks the inverter half bridge. Connected in parallel with the first switch is a second switch, which in the case of reinsertion at least one gas discharge lamp briefly lowers the supply voltage of the driving circuit still further, with the result that the first switch can block. Detecting the insertion of the gas discharge lamp into its holder, that is to say detecting the connection to the ballast, can be performed at very low power. This permits the second controlled switch, for which only the control power has to be applied. As a result, the components provided for driving it and which produce a connection to the gas discharge lamp can be components subjected to low loading. It is possible to use capacitors of low dielectric strength, and high-resistance resistors. This permits, above all, the use of components with very small dimensions and, in particular, the use of SMD components.

This is also rendered possible by virtue of the fact that the supply voltage of the driving circuit is lowered only to a relatively large, non-zero value, which, however, is below the threshold voltage UVLO for inactivating the driving circuit. As a result, the self-holding first switch can be completely blocked without the second controlled switch needing to be completely switched through (rendered very low-resistance). It is sufficient if the second switch merely lowers the potential somewhat further, and this likewise renders it possible to design the corresponding monitoring circuit in a high-resistance fashion.

The circuit generating an essentially fixed potential offset can be a Z diode or another type of component such as, for example, a resistor. A knee-type characteristic (Z diode, light-emitting diode or the like) is advantageous, however. The detector circuit is preferably connected to a terminal of the gas discharge lamp which is connected via the filament of the gas discharge lamp circuit point to which DC voltage is applied. As a rule, the DC voltage is the intermediate circuit voltage. Although during lamp operation AC voltages of different frequency are also present at this circuit point, which then drop across the filament, these AC voltages are uniquely distinguishable from voltage peaks which occur when this terminal is brought abruptly up to the intermediate circuit voltage from virtually frame potential during insertion of the lamp. The separation of the signals occurring can be undertaken in a simple way by a filter circuit which contains a high-pass filter, in particular. Low-pass filters can be provided for suppressing interference frequencies of low type, the result being finally to produce a bandpass characteristic or a filter characteristic which is otherwise suitable.

Use may be made as the controlled switch for turning off in the case of lamp faults (first switch) of a thyristor or a transistor equivalent circuit therefor which contains a pnp transistor and an npn transistor which are connected back to back with the collectors and base. The emitters form the ends of the switching path, one base forming a control input. The advantage of the transistor combination resides in the settable and preferably relatively low holding current, which must be extracted from the intermediate circuit voltage when the ballast is turned off, and thus consequently has a low power loss occurring with the ballast turned off. If the holding current is very low, the second switch can also be designed to have a relatively high resistance, and this can also be advantageous. Moreover, transistors are available as cost effective SMD components.

The gas discharge lamps are in each case connected individually in parallel to a capacitor of a series resonant circuit, the series resonant circuits being connected, in turn, in parallel with the output of the invertor half bridge. This leads to decoupling of the gas discharge lamps from one another.

Further details and advantages of the embodiments follow from the description below and the associated drawings.

Illustrated in the single FIGURE of the drawing is a block diagram of the ballast according to the invention which, in addition to a circuit for turning off in the case of overvoltage across a connected gas discharge lamp, contains a further circuit component for permitting automatic restarting.

DESCRIPTION

Represented in the block diagram in the FIGURE is an electronic ballast 1 which serves to operate one or more low-pressure gas discharge lamps 2*a*, 2*b*. The electronic ballast 1 has a system rectifier and transformer circuit 3 which supplies an intermediate circuit voltage of approximately 400 volts against frame 4. In order to generate the symmetrical AC voltage required to operate the low-pressure gas discharge lamps 2*a*, 2*b* from the intermediate circuit voltage, use is made of an inverter half bridge 6 which is formed in the present example by two MOSFETs 7, 8. Their drain-source paths are bridged in each case by damping diodes. The inverter half bridge 6 is connected between the intermediate circuit voltage and frame 4.

In order to drive the inverter half bridge 6, use is made of a driving circuit 11, which preferably contains an integrated circuit such as, for example, the L 6569 of SGS-Thomson and has two output terminals 12, 13 connected to the gates of the MOSFETs 7, 8. The integrated circuit of the driving circuit 11 is provided with an external circuit (not represented in more detail) which sets a specific operating frequency. This means that driving signals for the MOSFETs 7, 8 are present at the output terminals 12, 13 in a push-pull fashion at a given frequency in such a way that the MOSFETs 7, 8 open or are switched on alternately, but not in an overlapping fashion.

The driving circuit 11 has a supply voltage terminal $V_{CC}$, via which it is provided with operating voltage and, simultaneously, with information on whether it is to drive or block the MOSFETs 7, 8:

If the supply voltage $V_{CC}$ exceeds a fixed threshold value UVLI (undervoltage lockin), the driving circuit 11 alternately turns the MOSFETs 7, 8 on and off with a frequency which is prescribed by the external circuit. If the supply voltage $V_{CC}$ goes below the threshold value UVLO, the two MOSFETs 7, 8 are blocked.

The supply voltage is generated when the electronic ballast 1 is running, that is to say the connected low-pressure gas discharge lamps 2*a*, 2*b* glow, from the square-wave voltage generated by the invertor half bridge 6. This purpose is served by two capacitors C1 and C2, which are both connected to in each case one terminal by a connecting point 16 which forms the output of the inverter half bridge 6. The connecting point 16 is formed by the connection of source and drain of the MOSFETs 7, 8. Via the diodes D1 and D2 connected in series with the capacitors C1 and C2, charge packets are pumped at the inverter frequency of approximately 30 kHz to a smoothing or buffer capacitor C3, which is connected to frame 4 and from which the supply voltage is led to the corresponding supply voltage terminal of the driving circuit 11. A voltage rise is prevented by a Z diode DZ1, which is connected to the anode of D1 and is connected to frame with its own anode.

In order to permit the supply voltage for the driving circuit 11 to be generated even before the invertor half bridge 6 is driven and inverted, a resistor R1 is provided which is connected with one end to the intermediate circuit voltage and with the other end to the capacitor C3. The capacitor C3 is charged with a low current via the resistor R1 until the voltage across the capacitor C3 exceeds the threshold voltage UVLI and the driving circuit 11 starts up.

The gas discharge lamps 2*a*, 2*b* to be operated by the electronic ballast are connected directly via a respective resonance reactor L1*a*, L1*b* and a respective coupling capacitor C4*a*, C4*b* to the connecting point 16 which forms the output of the inverter half bridge 6 and is switched between the intermediate circuit voltage and frame at the frequency prescribed by the driving circuit 11. The series circuit of the resonance reactor L1*a* and the coupling capacitor C4*a* is connected via a lamp holder (not represented in more detail) to a terminal 21*a* of the gas discharge lamp 2*a*. The terminal leads outward via a filament 22*a* situated in the gas discharge lamp 2*a* to a terminal 23*a* which is connected via a resonance capacitor C5*a* to a further terminal 24*a* of the gas discharge lamp 2*a*, which is led to a filament 25*a* and, via the latter, to a terminal 26*a* which is at the intermediate circuit voltage.

While the resonance reactor L1*a* and the resonance capacitor C5*a* form a series resonance circuit which causes a voltage, which can exceed the intermediate circuit voltage, to drop across the gas discharge lamp 2*a* in the case of undamped resonance, the coupling capacitor C4*a* serves merely to isolate the gas discharge lamp 2*a* in terms of direct current from the inverter half bridge 6, with the result that the lamp current contains no DC component.

An identically constructed, parallel-connected lamp branch contains the gas discharge lamp 2*b*, as well as a series resonance reactor L1*b*, a coupling capacitor C4*b* and a resonance capacitor C5*b*.

The purpose of monitoring the voltages dropping across the gas discharge lamps 2*a*, 2*b* is served by a voltage monitoring circuit 27 which contains two circuit parts 27*a*, 27*b* which are respectively assigned to the gas discharge lamps 2*a*, 2*b*. They are connected in each case via a high-resistance resistor R2*a*, R2*b* to the lamp-side end of the respective resonance reactor L1*a*, L1*b*. Each circuit part 27*a*, 27*b* further contains on the input side an input resistor R3*a*, R3*b*, which forms a voltage divider with the respective resistor R2*a*, R2*b* and is connected to frame 4.

Connected downstream of the input resistor R3*a*, R3*b* in each case is a voltage doubler connection 28*a*, 28*b* which outputs with its output 29*a*, 29*b* a DC voltage signal which corresponds to the lamp voltage of the respective gas discharge lamp 2*a*, 2*b*. The outputs 29*a*, 29*b* of the partial circuits 27*a*, 27*b* are connected in parallel with one another and with a control input 31 of a first controllable switch 32, which is connected with one end to frame 4. Its other end is connected via a voltage offset circuit 33 to the supply voltage of the driving circuit 11.

The switch 32 is formed by an npn transistor T1 and a pnp transistor T2. The emitter of T1 is connected to frame 4, and its collector is connected to the base of T2. The collector of T2 is connected to the base of T1 which, in addition, is connected to frame 4 via a resistor R4 and a capacitor C5. The base of T2 is connected to its emitter via a resistor R5 and a capacitor C6. The transistors T1 and T2 form a bistable circuit which either assumes a non-conducting state in which the path from the emitter of T2 is blocked by the emitter of T1 (blocking state) or conducts (conducting state). By means of a voltage signal at the control input 31, the switch 32 is converted via a Z diode DZ3 from its blocking state into its conducting state, which is maintained until a low holding current, which can be set by the resistor R5, is fallen below. In the conducting state, the emitter of T2 is virtually at frame 4.

The voltage offset circuit 33, which is formed in the simplest case by a Z diode DZ2, has a voltage drop which is less than the threshold voltage UVLO. The driving circuit 11 is thereby reactivated when the switch 32 conducts. If the voltage monitoring circuit 27 detects an excessively high voltage across the gas discharge lamp 2*a* or across the gas discharge lamp 2*b*, it switches the switch 32 into its conducting state, as a result of which the latter blocks the driving circuit 11 by lowering the supply voltage $V_{CC}$ below UVLO.

In order to permit restarting after changing the lamp, the supply voltage $V_{CC}$ is additionally connected via an optional resistor R7 to a controllable switch 34 which is connected to frame 4. The switch 34 need not be a switch in the binary sense, but has a non-conducting state in which the current path from the resistor R7 to frame 4 is blocked, as well as a further state in which a certain flow of current is permitted, it being entirely possible for the flow into the resistor of the switch 34 also to have a relatively large value.

The switch 34 is formed by a circuit whose main part is an npn transistor T3. Its emitter is connected to frame 4, and its collector is connected to R7. Its base is connected to a capacitor C10 against frame 4 in order to avoid interference. Provided in parallel with C10 is a resistor R10, which keeps T3 statically in a non-conducting state. Also connected to the base of T3 are two RC combinations 36*a*, 36*b*, which belong to tapping circuits 37*a*, 37*b* which serve to detect a change of lamp. Each tapping circuit 37*a*, 37*b* is respectively assigned to a gas discharge lamp 2*a*, 2*b*. On the input side, each RC combination 36*a*, 36*b* has a capacitor C11*a*, C11*b* which forms a low-pass filter with a resistor R11*a*, R11*b* leading to the respective RC combination 36*a*, 36*b*. At the same time, the resistors R11*a*, R11*b* form an ohmic voltage divider with input resistors R12*a*, R12*b*. Starting from said voltage divider, a capacitor C12*a*, C12*b* leads in each case to the resistor R10, and forms a high-pass filter therewith.

Instead of the two low-pressure gas discharge lamps 2*a*, 2*b*, it is also possible to provide further gas discharge lamps which are then connected to corresponding lamp branches having resonance reactor and resonance capacitor as well as coupling capacitor, and which are assigned further RC combinations 36.

The circuit so far described operates as follows:

During correct operation of the gas discharge lamps 2*a*, 2*b*, there is available as supply voltage $V_{CC}$ for the driving circuit 11 a voltage which exceeds the threshold voltage UVLO. The inverter half bridge 6 provides an AC voltage by means of which the low-pressure gas discharge lamps 2*a*, 2*b* are started and operated. Via the resistors R2*a*, R2*b*, the voltage monitoring circuit 27 detects a voltage which is lower than a prescribed maximum value. Consequently, the voltage present at the control input 31 of the switch 32 does not exceed a starting voltage which would be required in order to switch the switch 32 to a low resistance.

However, if the low-pressure gas discharge lamp 2*a* and/or or 2*b* exhibits a fault which causes the operating voltage to rise impermissibly, this is detected by the voltage monitoring circuit 27, and the switch 32 is started by a signal at its control input 31. Via the Z diode DZ2, it thereby clamps the supply voltage $V_{CC}$ to an extent below UVLO. The inverter half bridge 6 thus blocks completely. This state is maintained by the self-holding nature of the switch 32. A corresponding self-holding current is supplied via the resistor R1 from the intermediate circuit voltage.

This state is also maintained when the defective or both gas discharge lamps 2*a*, 2*b* are removed from the respective holder. The end of the resistor R11*a*, R11*b* bearing against the respective terminal 24*a*, 24*b* is thus separated from the intermediate circuit voltage and drops to a lower potential or frame potential. The transistor T3 in no way receives base current and remains blocked as before. However, as soon as a gas discharge lamp 2*a* or 2*b* is inserted into its respective holder, the relevant terminal 24*a* or 24*b* is connected to the intermediate circuit voltage. Via the respective high-pass capacitor C12*a* or C12*b*, the instantaneous steep voltage rise generates a positive pulse at the base of T3, which thereby is turned on briefly. With its collector, it draws a voltage, via R7, below the value set by the switch 32 and the Z diode DZ2, and thus also briefly takes over the current supplied by R1. The switch 32 therefore blocks, with the result that the supply voltage $V_{CC}$ can assume its value required for operating the driving circuit 11 when the transistor T3 blocks again shortly thereafter.

The output capacitors of the partial circuits 27*a*, 27*b* can also be combined. The charges supplied by the two partial circuits 27*a*, 27*b* are added at the capacitor, and this switches the half bridge 6 off when both lamps 2*a*, 2*b* are removed from their holders. This serves to protect the half bridge 6.

For the purpose of driving its inverter half bridge 6, an electric ballast 1 for the alternative operation of one or more gas discharge lamps 2*a*, 2*b* has a driving circuit 11 which prescribes the inverter frequency. In the event of overvoltage across one of the gas discharge lamps, the driving circuit 11 is brought into a locking state in which it blocks the inverter half bridge 6. This is performed via a circuit resembling a thyristor, which reduces the supply voltage of the driving circuit 11 below a value UVLO. Provided for the purpose of unlocking and restarting is a detector circuit which detects the insertion of a new gas discharge lamp 2*a*, 2*b* into its respective holder. This is accomplished by pinpoint detection of a steep pronounced voltage rise at a terminal of the gas discharge lamp which is connected to the intermediate circuit voltage via the filament of a gas discharge lamp. The detector circuit contains a filter which filters out and evaluates the voltage rise and suppresses interference voltages which could otherwise lead to defective restarting operations.

We claim:

1. An electronic ballast for operation of at least two low-pressure gas discharge lamps, comprising:

a DC voltage source which supplies current to at least said gas discharge lamps, at least one half bridge, which is connected to said DC voltage source and supplies an AC voltage at an output terminal, wherein said output terminal is connected to said gas discharge lamps via coupling means, a driving circuit connected via control terminals to said half bridge, said driving circuit driving said half bridge at a settable frequency, and having a supply voltage input connected to a supply voltage, wherein if said supply voltage exceeds a threshold value the driving circuit adopts an active operating mode and drives said half bridge at a given frequency, and wherein if said supply voltage falls below a second threshold value said driving circuit adopts a passive operating mode and blocks said half bridge, a first controlled switch with a self-holding characteristic and which is connected to said supply voltage against a frame, said first controlled switch reducing said voltage below said second threshold value when it is closed, wherein said first controlled switch is connected in series with a circuit for generating a potential offset when said first controlled switch is closed, said first controlled switch alternatively controlled by a voltage monitoring circuit for monitoring said gas discharge lamps so that said first controlled switch is closed when said voltage monitoring circuit detects an impermissible state at at least one of said gas discharge lamps, whereby said supply voltage is lowered to below said second threshold value, and a second controlled switch, which can alternatively assume a non-conducting state and a conducting state, in which it switches said first controlled switch to said non-conducting state, and whose control input is connected to a detector circuit which is assigned to said respective gas discharge lamp, and which detects a connection of a gas discharge lamp to said electronics ballast.

2. An electronic ballast according to claim 1, characterized in that the circuit for generating a potential offset is a Z diode.

3. An electronic ballast according to claim 2, characterized in that the Z diode has a breakdown voltage slightly lower than the second threshold value.

4. An electronic ballast according to claim 1, characterized in that the circuit for generating a potential offset is a resistor.

5. An electronic ballast according to claim 1, characterized in that the detector circuit is connected to at least one terminal of a respective gas discharge lamp, which is connected via a filament of said respective gas discharge lamp to a circuit point to which a DC voltage is applied.

6. An electronic ballast according to claim 1, characterized in that the detector circuit further comprises a filter circuit.

7. An electronic ballast according to claim 6, characterized in that the filter circuit comprises a high-pass filter.

8. An electronic ballast according to claim 6, characterized in that the filter circuit comprises a low-pass filter.

9. An electronic ballast according to claim 1, characterized in that the second switch is connected to the supply voltage against a frame, and said second switch lowers the supply voltage of the driving circuit further than the first switch when said detector circuit outputs a predetermined signal.

10. An electronic ballast according to claim 1, characterized in that the first controlled switch is formed by a pnp transistor and an npn transistor, whose base and collector are alternately connected to one another and whose emitters form the external connections of the switching path of the first controlled switch, wherein the base of said npn transistor is a a control input.

11. An electronic ballast according to claim 1, characterized in that the second controlled switch is a thyristor.

12. An electronic ballast according to claim 1, characterized in that the second controlled switch is a transistor.

13. An electronic ballast according to claim 12, characterized in that the second controlled switch is an npn transistor operated in common emitter mode, whose collector is connected via a resistor to the supply voltage, and whose emitter is connected to a frame.

14. An electronic ballast according to claim 13, characterized in that the base of the npn transistor operated in common emitter mode is connected to a high-resistance resistor against a frame.

15. An electronic ballast according to claim 1, wherein said detector circuit comprises a plurality of tapping circuits, whereby said tapping circuits are respectively assigned to a gas discharge lamp and each tapping circuit comprises a voltage divider with a low-pass characteristic, a high-pass filter and a low-pass filter.

16. An electronic ballast according to claim 1, characterized in that at least one of said gas discharge lamps is connected to one voltage-raising series resonant circuit.

17. An electronic ballast according to claim 1, characterized in that the coupling element for connecting said gas discharge lamps to said half bridge comprises coupling capacitors for suppressing DC components.

18. An electronic ballast according to claim 1, characterized in that for the purpose of monitoring the voltage across said gas discharge lamps said voltage monitoring circuit has a high-resistance current path comprising first resistors, which at one end are connected to a resonance reactors said resonance reactor connected at one end to the half bridges said first resistors being connected at their respective other ends to second resistors, said second resistors being connected in each case at one end to a frame, whereby said first and second resistors form a voltage divider.

19. An electronic ballast according to claim 18, characterized in that a rectifier circuit is connected to said voltage divider.

20. An electronic ballast according to claim 19, characterized in that the rectifier circuit has an output which is connected to the control terminal of the first controllable switch.

21. An electronic ballast for operation of at least one low-pressure gas discharge lamp, comprising:

a DC voltage source for supplying current to said at least one gas discharge lamp; said gas discharge lamp having a filament as an electrode, at least one half bridge connected to said DC voltage source and for supplying an AC voltage to said at least one gas discharge lamp;

a driving circuit connected to said at least one half bridge for driving said half bridge at a set frequency, said driving circuit having a supply voltage input connected to a supply voltage, said driving circuit adopting an active operating mode when said supply voltage exceeds a first threshold value and driving said at least one half bridge, and if said supply voltage falls below a second threshold value said driving circuit adopting a passive operating mode and blocking normal operation of said at least one half bridge, a first control switch which is connected to said supply voltage against a frame, said first control switch for reducing said supply voltage below said second threshold value when it is closed, wherein said first control switch is connected in series with a zener diode having a breakdown voltage below said second threshold voltage value, said zener diode for generating a potential offset when said first control switch is closed, and said first control switch connected to a voltage monitoring circuit for monitoring a voltage at said at least one gas discharge lamp so that said first control switch is closed when said voltage monitoring circuit detects an impermissible state at at least one gas discharge lamp, and whereby said supply voltage is lowered to below said second threshold value, and a second control switch, having a non-conducting state and a conducting state, said second control switch for switching said first control switch to a non-conducting state, and having a control input connected to a detector circuit assigned to a respective one of sad at least one gas discharge lamp, for detecting the connection of a gas discharge lamp to said electronic ballast.

* * * * *